US006821038B2

(12) United States Patent
Izawa

(10) Patent No.: US 6,821,038 B2
(45) Date of Patent: Nov. 23, 2004

(54) NEWSPAPER PRODUCING METHOD

(75) Inventor: Hideo Izawa, Narashino (JP)

(73) Assignee: Miyakoshi Printing Machinery Co., Ltd., Chiba (JP)

( * ) Notice: Subject to any disclaimer, the term of this patent is extended or adjusted under 35 U.S.C. 154(b) by 0 days.

(21) Appl. No.: 10/317,099

(22) Filed: Dec. 12, 2002

(65) Prior Publication Data

US 2003/0219297 A1 Nov. 27, 2003

(30) Foreign Application Priority Data

May 24, 2002 (JP) ..... P2002-150842

(51) Int. Cl.[7] ..... B41J 11/68

(52) U.S. Cl. ..... 400/621.1; 101/224; 101/226; 101/229; 270/5.01; 270/5.02; 270/40

(58) Field of Search ..... 400/120.01, 621, 400/621.1; 101/147, 219, 224, 226, 229; 270/40, 5.01, 5.02

(56) References Cited

U.S. PATENT DOCUMENTS 4,063,398 A * 12/1977 Huffman ..... 53/412
4,671,501 A * 6/1987 Fujishiro ..... 270/21.1
5,699,735 A * 12/1997 Stein et al. ..... 101/219
6,010,122 A * 1/2000 Weber ..... 270/41
6,036,187 A * 3/2000 Schaede ..... 271/204
6,120,142 A * 9/2000 Eltgen et al. ..... 347/104
6,186,553 B1 * 2/2001 Phillips et al. ..... 283/2
6,338,298 B2 * 1/2002 Schneider et al. ..... 101/179
6,363,851 B1 * 4/2002 Gerhard et al. ..... 101/483
6,408,747 B2 * 6/2002 Koppelkamm et al. ..... 101/147
6,533,324 B2 * 3/2003 Zorn ..... 283/56
RE38,304 E * 11/2003 Bergmans et al. ..... 347/262

* cited by examiner

*Primary Examiner*—Andrew H. Hirshfeld
*Assistant Examiner*—Dave A. Ghatt
(74) *Attorney, Agent, or Firm*—Wenderoth, Lind & Ponack, L.L.P.

(57) ABSTRACT

A newspaper producing method can produce a plurality kinds of newspapers different in page numbers and colors by using a single printing unit. This method includes a plurality of printing cycles, each of which produces a plurality of lateral printed rows on each side of a continuous web, with each row having different contents relative to each other, with each row having at least two printed segments in a width direction of the continuous web, and with rows on opposite sides of the continuous web corresponding to each other. This printed continuous web is cut with respect to each of the lateral printed rows and each two-page spread of newspaper, and these cut portions are set and are delivered for every printing cycle. Each set of these portions is folded at a longitudinal central portion of a two-page spread thereof.

9 Claims, 4 Drawing Sheets

NEWSPAPER PRODUCING METHOD

BACKGROUND OF THE INVENTION

1. Field of the Invention

The present invention relates to a method of producing newspaper having a number of pages such as sixteen pages, thirty-two pages, forty pages, etc.

2. Related Art

In a known art, newspaper is produced by steps of printing a continuous web of paper in a form of a double-width size web sheet (laterally corresponding to four pages of newspaper) by using a rotary press, slitting this printed continuous web in its longitudinal direction into two portions (each laterally corresponding to two pages of newspaper) by using a slitter, overlapping the two portions and then folding them in their longitudinal direction by using a former, cutting this folded paper web in its transverse direction so as to have a predetermined vertical length of the newspaper and then delivering the same.

FIG. 4 shows a process explaining the above newspaper producing steps by using a blanket-blanket type offset rotary press. With reference to FIG. 4, the offset rotary press includes two opposed plate cylinders a, each of which is mounted with a printing plate having two lateral printing rows juxtaposed in a circumferential direction, and each of which having four printing surfaces adapted to print four pages of A, B, C and D or E, F, G and H of the newspaper in an axial direction of the plate cylinders. According to complete rotations of two opposed blanket cylinders b, a continuous web of paper c (which will be called hereinlater "continuous web" or merely "web") is printed by eight pages on respective surfaces of both sides of the continuous web. In such case, the continuous web c has a width twice a lateral width of a newspaper having four pages when the latter is opened, i.e. 1625 mm (64 inches).

Thereafter, by using a slitter, the continuous web c is slit into two portions in a longitudinal direction at an intermediate portion in a width direction of the web, and the two portions are overlapped at a gathering (collecting) section using a turn bar e. Thereafter, these overlapped portions are folded in folio in the longitudinal direction by using a former f, and then, this folded web is cut with respect to each row to thereby produce two kinds of newspapers each including eight pages, alternately in order.

At a time when the newspaper is produced by using a printing unit of a plate cylinder structure mentioned above, supposing that one printing unit has an ability for printing, for example, two kinds of eight pages, such as mentioned above, when a newspaper of sixteen, thirty-two and forty pages is printed, it is necessary to use a two-unit type, three-unit type or four-unit type rotary press having these two kinds of 8-page printing units, of which the number is increased to two (2), three (3) or 4 (four).

FIG. 5 shows a 4-unit type rotary press including four printing units $g_1$, $g_2$, $g_3$ and $g_4$. Each of continuous webs c printed respectively at the printing units $g_1$ to $g_4$ is divided into two parts by a slitter h, and then they are gathered by using a turn bar group of a collection unit i. Thereafter, the continuous webs c are folded in folio by former f and then again folded by a folding apparatus j.

As mentioned hereinbefore, when a newspaper is produced by using a conventional plate-cylinder type printing unit, it is necessary to increase a number of printing units every time a number of pages of the newspaper is increased, thus being disadvantageous in production cost and installation space. Particularly, the four-unit type rotary press such as shown in FIG. 5 is considerably large in size, and hence, it requires large installation space and is, moreover, expensive.

Furthermore, with such a conventional printing unit, it is difficult to increase pages of a newspaper after a first setting thereof because of limitations with regard to installation space. Moreover, in multi-color printing, since a number of printing units are required, and hence a traveling path for a continuous web is extremely elongated, there results losses in paper and time only in a paper threading process, and furthermore, much paper (web) loss results until a tension is stabilized and a different color registration is made. In addition, it is required to change a printing plate every time contents to be printed are changed, which will not be profitable in production of a small number of lots.

SUMMARY OF THE INVENTION

An object of the present invention is to substantially eliminate defects or drawbacks encountered in the prior art mentioned above, and to provide a newspaper producing method capable of producing a plurality kinds of newspapers including page numbers and colors different from each other, by utilizing a single printing unit, wherein the method is profitable for printing a small number of lots.

This and other objects can be achieved according to the present invention by providing a method of producing newspaper, comprising:

printing on both sides of a continuous web repeatedly in a printing direction, which printing includes a plurality of printing cycles each producing a plurality of lateral printed rows on each side of the continuous web, with each row having different contents relative to each other, with each row having at least two printed segments in a width direction of the continuous web, and with rows on opposite sides of the continuous web corresponding to each other;

cutting this printed continuous web with respect to each of the lateral printed rows and each two-page spread of newspaper, and setting and delivering a set of these cut portions at every printing cycle; and folding each set of the cut portions at a longitudinally central portion of a two-page spread thereof;

whereby a newspaper of pages corresponding to the printing cycle is repeatedly produced.

In a preferred embodiment of this newspaper producing method, both sides of the continuous web are printed at a portion thereof traveling in a vertical direction. This printing is performed by using a digital printing machine including printing heads opposed to both sides of the continuous web, respectively, wherein each printing head is arranged opposite to another printing head at the same level in vertical direction. The printing may also be performed by using a digital printing machine including printing heads opposed to both sides of the continuous web, respectively, wherein the printing heads are offset relative to one another in a printing direction.

According to the present invention including the features mentioned above, both sides of a continuous web are printed repeatedly, by using a digital printing machine, in a printing direction such that this printing step includes a plurality of printing cycles each of which produces a plurality of lateral printed rows on each side of the continuous web, with each row having different contents relative to each other, with each row having at least two printed segments in a width direction of the continuous web, and with rows on opposite sides of the continuous web corresponding to each other. Therefore, a number of printed rows in a printing direction produced during a printing cycle mentioned above can be changed, and hence, it becomes possible to optionally produce newspapers different in pages and/or colors by using one set of a web feeding section and printing section. Thus, it is not necessary to increase a number of printing units, as with the conventional printing method using a rotary press, in conformity with pages and/or colors, and hence, according to the present invention, a newspaper can be produced at a reduced production cost and reduced printing system installation space.

Moreover, use of a digital printing machine makes it possible to easily change contents to be printed without changing a printing plate or the like, as with the conventional rotary press, and accordingly, only one lot printing can be performed with commercial profit.

Furthermore, since multi-color printing can be performed by using a digital printing machine which is compact, allowed for is a printing system that has a reduced web traveling path, and which can be operated with stable tension and reduced paper (web) loss during a web feeding process or different color registration process.

Further, the above and other objects, many other characteristic features and advantageous effects and the like of the present invention will be made more clear from the following descriptions made with reference to the accompanying drawings.

DETAILED DESCRIPTION OF THE PREFERRED EMBODIMENTS

One embodiment of the present invention will be described hereunder with reference to a case of producing newspaper of thirty-two pages which is foldable in folio.

Figure 1:
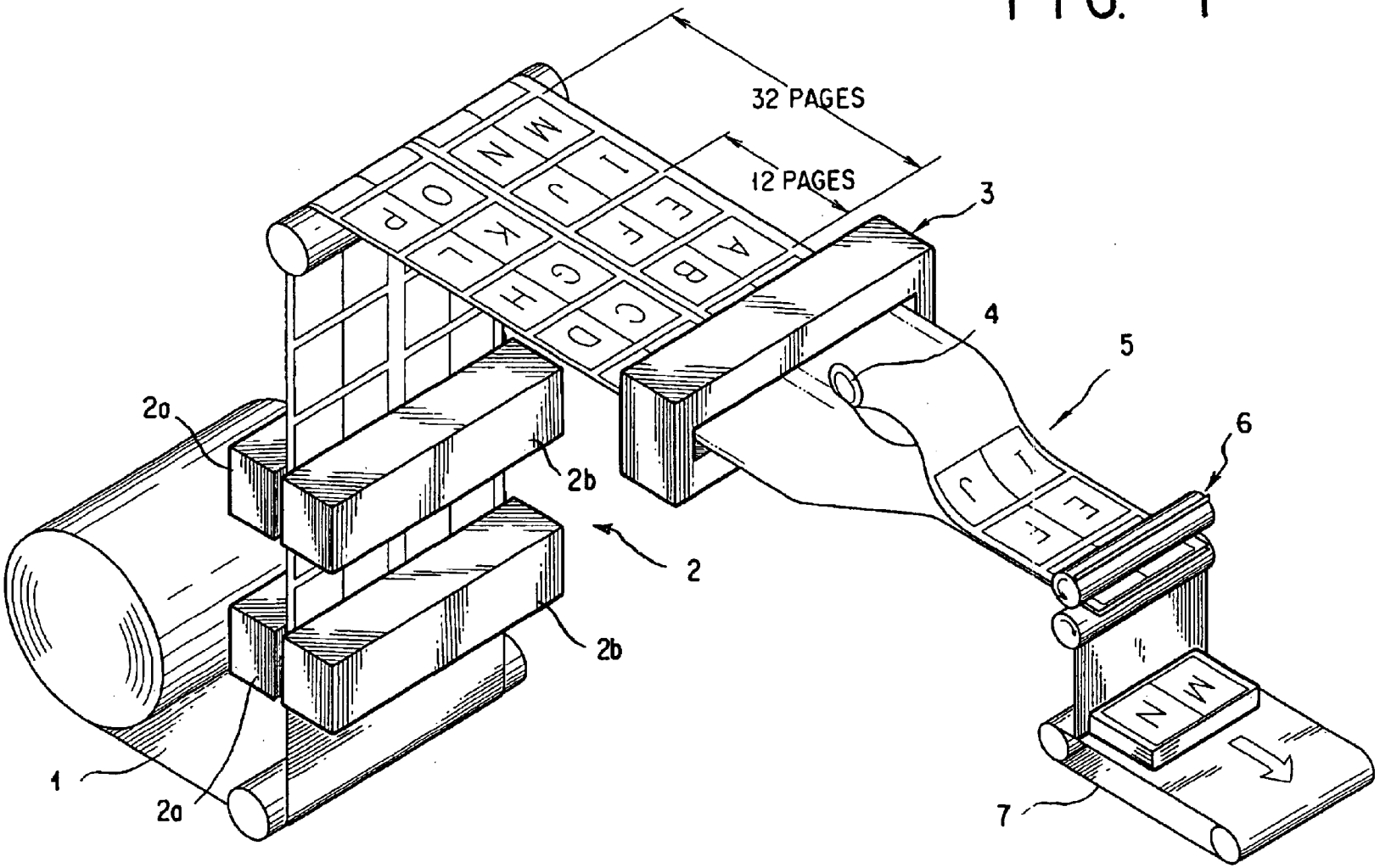
FIG. 1 is an illustration for explanation of an embodiment according to the present invention.

With reference to FIG. 1, reference numeral 1 denotes a continuous web for double-width type newspaper. The continuous web 1 is subjected to double-side surface (perfect) printing by a double-side printing machine 2 disposed at a printing section, and the web 1 is dried by passing through a drier 3 and then split into two parts in a longitudinal direction thereof by a splitter 4. Thereafter, the two parts are overlapped at a gathering section 5 by using a turn bar (not shown) then cut by a cutter 6 so as to have a predetermined length (vertical dimension of the newspaper) and, thereafter, stacked on a conveyor 7 for making sets of newspapers each composed of a predetermined number of papers. These newspaper sets on the conveyor 7 are delivered and discharged in a shifted state for every newspaper set.

The double-side printing machine 2 is arranged at a position at which the continuous web 1 is traveling in a substantially vertical direction. This double-side printing machine 2 employs a digital printer such as an ink-jet printer or electro-photography printer which can change, at random, contents on each page of the newspaper to be printed by using an on-demand controller without using printing plates.

The double-side printing machine 2 has printing heads 2*a* and 2*b*, one of which is disposed opposed to one of both (two) sides of the continuous web 1. However, in a case of large volume of printing contents or multi-color printing, two to four printing heads may be additionally arranged along a printing direction (traveling direction of the continuous web 1) as occasion demands.

Further, it is not absolutely necessary for the printing heads 2*a* and 2*b* disposed on respective sides in an opposing manner to be arranged at the same positions along the printing direction, and the printing heads 2*a* and 2*b* may be arranged in an offset manner in the printing direction so long as a printing timing of both printing heads can be controlled so that both printed surfaces of both sides of the newspaper correspond to each other.

At a double-side printing section by using the double-side printing machine 2, one side of the continuous web 1 is provided with printed segments being arranged in four lateral rows juxtaposed in the printing direction, with each row including four printed segments corresponding to pages A–D, E–H, I–L or M–P, and this four-row printing is repeatedly performed. On the other hand, the other side of the continuous web 1 is also printed in a manner substantially identical to that mentioned above. That is, four lateral rows, each including four printed segments corresponding to those of the above-mentioned one side, are printed in the printing direction, and this lateral four-row printing is repeatedly performed, and a pair of four-row printings on both sides of the continuous web 1 are performed as one printing cycle for the newspaper, and this cycle is repeated so as to print a required number of newspaper sets.

With reference to FIG. 1, the continuous web 1 of double-width size (including four lateral pages of newspaper), after images have been printed on both its sides, is then dried by the drier 3. The continuous web 1 of double-width size is slit into two parts by virtue of slitter 4 so as to provide two continuous webs each having a two-page spread width of the newspaper, which webs are then superimposed as a two-ply web at gathering section 5. Thereafter, the superimposed webs are cut by the cutter 6 so as to provide a two-page spread of newspaper each having a stacked vertical dimension as the newspaper, which are then stacked on the setting and delivering conveyor 7.

This setting and delivering conveyor 7 is operated intermittently. That is, at a time when the continuous web 1 (sheets of newspaper pages) cut by the cutter 6 are stacked on the conveyor by eight sheets, i.e. thirty-two pages, which corresponds to a printed amount in one printing cycle mentioned above, the conveyor is slightly moved so that the stacked newspaper sheets are slightly moved. This process is repeated and, then, sets of the newspapers, each including thirty-two pages, are piled and moved, having a slightly shifted state relative to each other, in a delivering direction. The newspapers on the conveyor are delivered in this state by a predetermined stroke or to a terminal end of the conveyor 7, and then removed one by one each as one set of newspaper.

In the described embodiment, for example, if it is required to produce a newspaper of sixteen pages, the number of lateral rows to be printed by one printing cycle is set to two (two lateral rows), and on the other hand, in a case of a newspaper of forty pages, the number of lateral rows to be printed by one printing cycle is set to five (five horizontal rows). In these states, printing is performed repeatedly in both cases.

Moreover, in the described embodiment, although there is described an example using the double-width continuous web 1, a single-width continuous web may also be used. Accordingly, in a case of a single-width web, the number of printed segments in each lateral row in the double-side printing machine 2 is half (½) of a double-width web, so that the number of lateral rows to be printed in one printing cycle becomes twice that the case of the double-width web.

Figure 2:
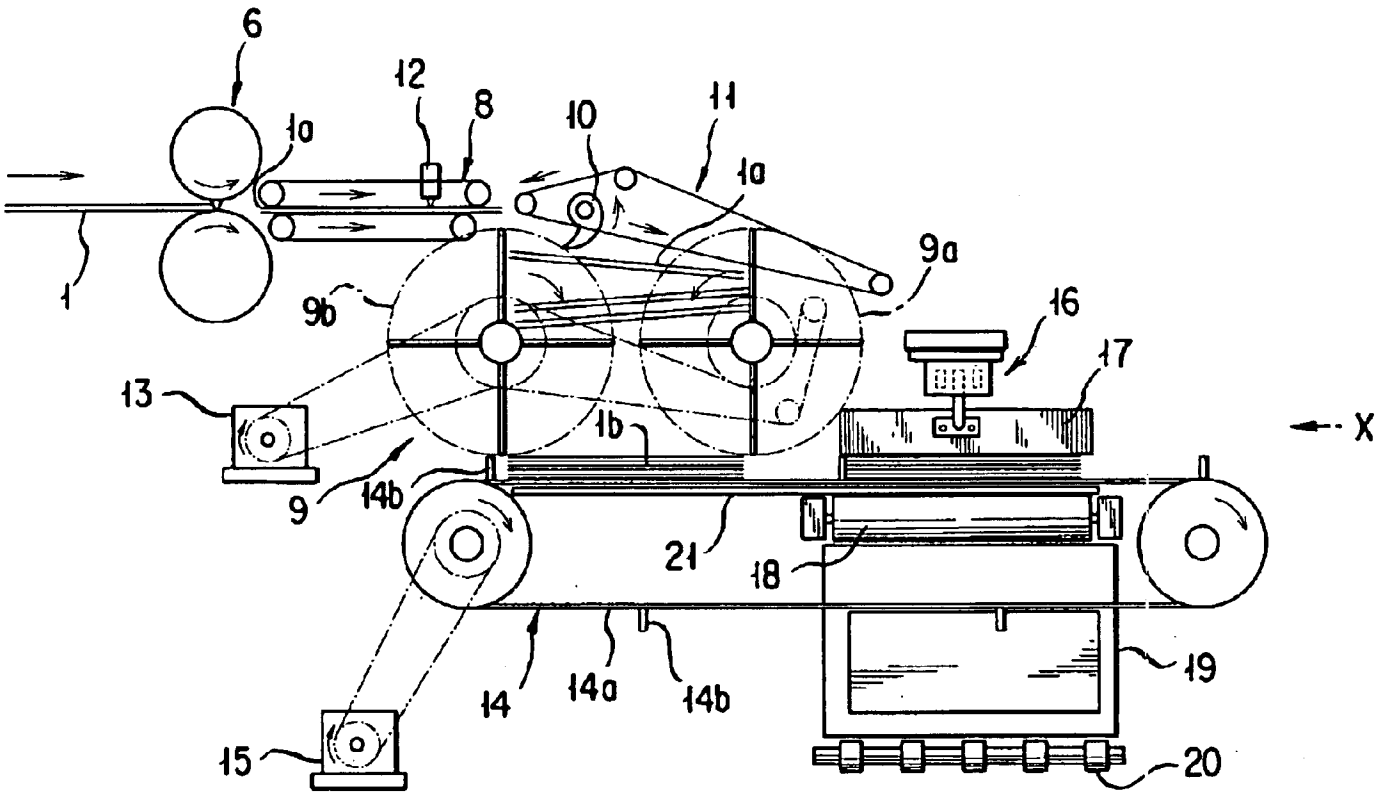
FIG. 2 is a schematic view showing a setting and delivering section, and a chopper folding section, of a printing system for explaining the embodiment of the present invention.
Figure 3:
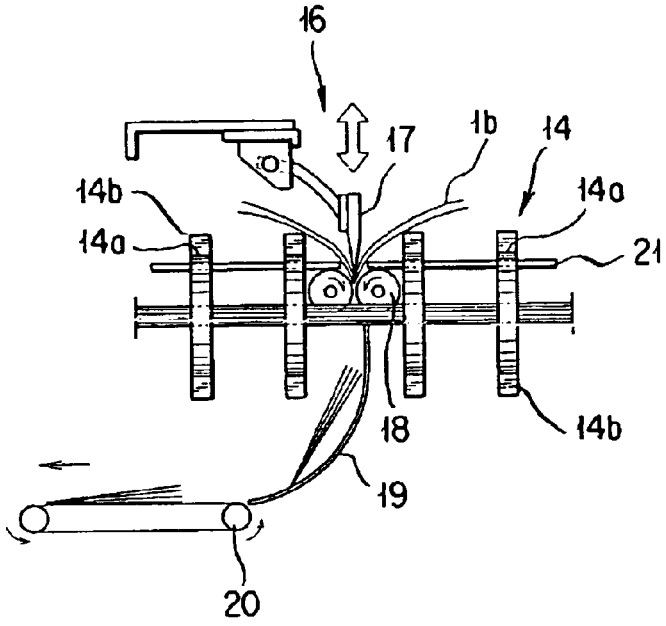
FIG. 3 is a view along arrow X in FIG. 2.
Figure 4:
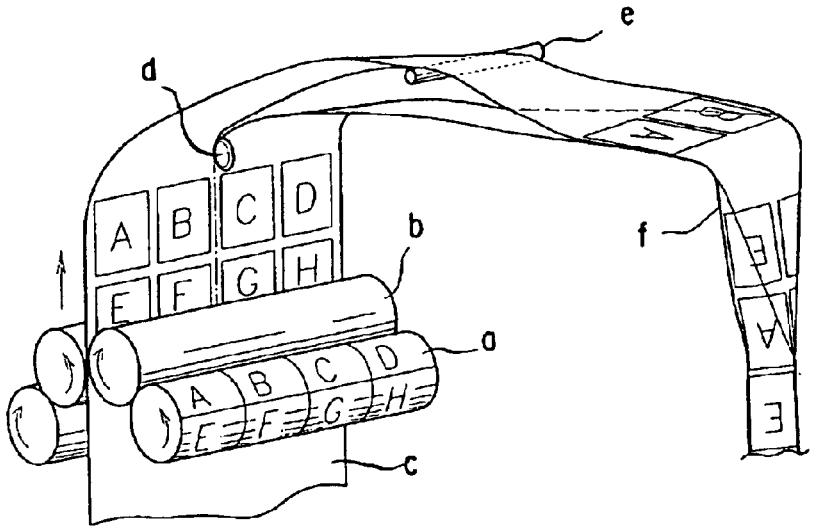
FIG. 4 PRIOR ART
FIG. 4 is a schematic view of a printing system of conventional structure.
Figure 5:
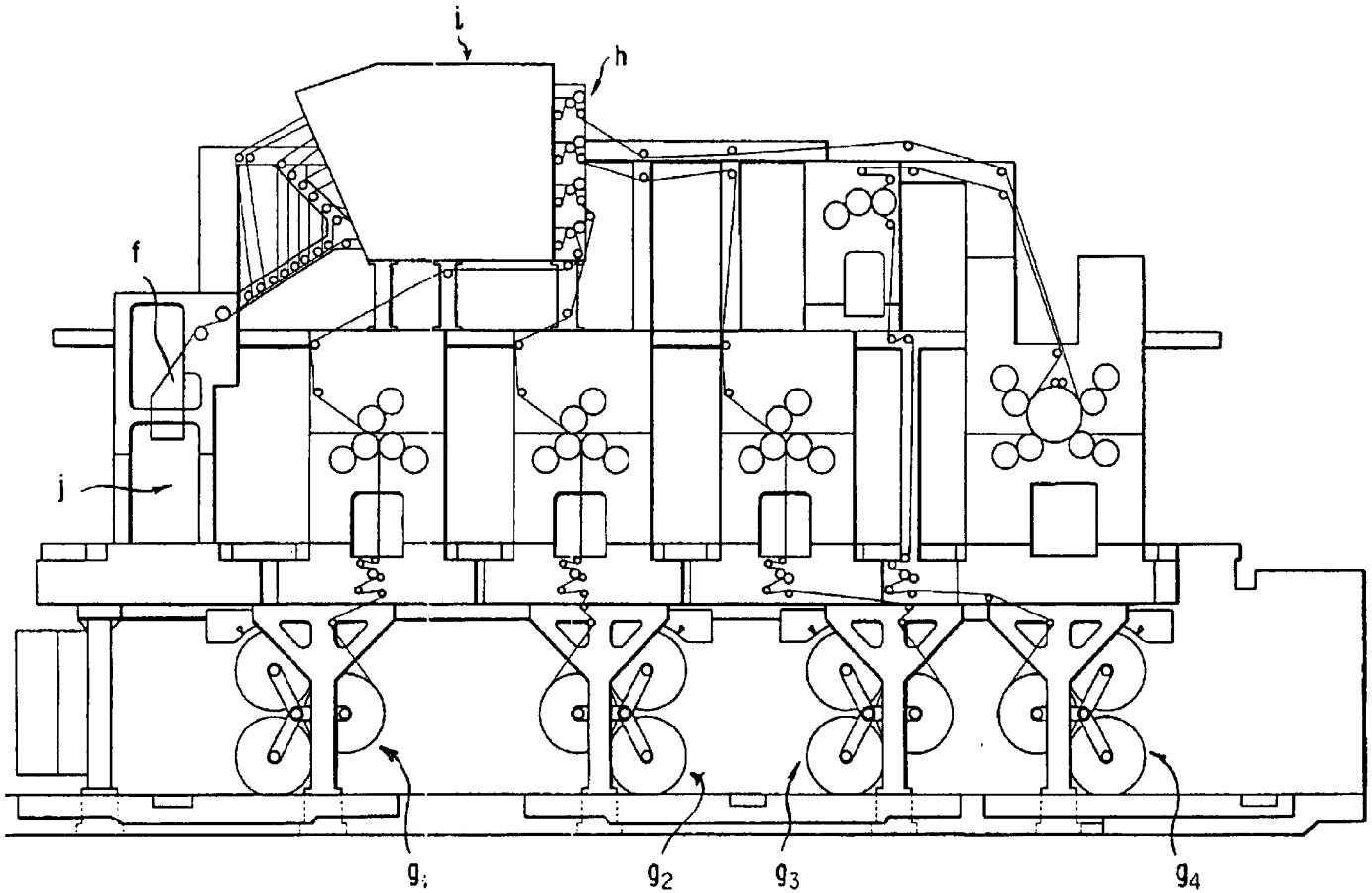
FIG. 5 PRIOR ART
FIG. 5 is a front view of a conventional rotary press.

FIG. 2 shows an arrangement of another example of a setting and delivering process. With reference to FIG. 2, cut portions 1*a* cut by cutter 6 are delivered intermittently one by one on an intermittently operated impeller device 9 via a delivering belt conveyor 8 at a delivering speed V2, which is slightly (about 5%) greater than an operating speed V1 of the printing machine itself. The cut webs 1*a* abut a blade or vane, in an upright attitude, of an upstream side impeller 9*a* and are then stacked on other blades, in a horizontal attitude, opposing each other, of a downstream side impeller 9*b* and the upstream side impeller 9*a*. Further, in FIG. 2, reference numeral 10 denotes a striker and 11 denotes a guide belt.

In this example of FIG. 2, the cut portions 1*a* stacked on the impeller device 9 are counted by a sensor 12 provided for the delivering belt conveyor 8, and for example, when four sets of two-ply cut portions 1*a* for a preset number of pages (sheets) of for example a 32-page newspaper pass the sensor 12, a servo-motor 13 instantaneously drives the impeller device 9 to thereby rotate both the impellers 9*a* and 9*b* by 90 degrees so as to move opposing blades in a horizontal attitude downwardly. Accordingly, the newspapers drop onto an intermittently driven conveyor 14 for every one set.

The conveyor 14 is intermittently driven by a servo-motor 15, and according to this intermittent motion, a set 1*b* dropped onto the conveyor 14 is delivered to a chopper folding device 16 disposed on a downstream side of the conveyor 14. Then, at this position, the set 1*b* is folded in folio, by a chopper blade 17 moving downwardly, at just an intermediate position in a width direction thereof, and discharged onto a delivery conveyor 20 along a guide 19 by virtue of chopper roller 18.

The conveyor 14 comprises a plurality of timing belts 14*a* which are horizontally arranged spaced from each other, and pressing plates 14*b* for feeding the set 1*b* under a pressed state are provided for surfaces of the timing belts 14*a*. The chopper folding device 16 is provided with a bottom board or plate 21 for supporting the set 1*b*.

Further, in the described embodiment, as a device for setting and delivering the cut portions 1*a*, cut by the cutter 6, onto the conveyor 14, as shown in FIG. 2, there is utilized an intermittently driven impeller device comprising a pair of impellers which intermittently rotate. However, this device may be a known continuous rotary-type impeller device, having a number of blades in its circumferential direction, wherein cut portions are subsequently inserted into a portion between blades of the continuous rotary-type impeller device and then the cut portions abut a baffle plate according to rotation of the impeller device and drop onto the conveyor 14.

It is further noted that, although the present invention is disclosed with reference to the preferred embodiment of a newspaper producing method, the present invention is not limited to such a specific embodiment, and many other applications will be suggested for those skilled in the art. Furthermore, there will be cause for experts in this art field to make various amendments, modifications and changes in details of the illustrated and described embodiment so as to conform with design or the like, or with necessity of applications.

What is claimed is:

1. A method of producing newspaper, comprising:

during a printing cycle, using a digital printing machine to sequentially print onto one side of a continuous web first lateral rows of images that differ from row to row, wherein each of said first lateral rows defines at least two printing segments in a width direction of said continuous web;

during said printing cycle, using said digital printing machine to sequentially print onto an opposite side of said continuous web second lateral rows of images that differ from row to row, wherein each of said second lateral rows defines at least two printing segments in a width direction of said continuous web, and wherein said second lateral rows correspond to said first lateral rows, respectively;

cutting said continuous web longitudinally with respect to each portion thereof that is to define a two-page spread of the newspaper, and laterally with respect to each of said first and second lateral rows of images, so as to provide cut portions that define a two-page spread of the newspaper;

in correspondence with said printing cycle, combining said cut portions into a set and delivering said set towards a folding station;

at said folding station, folding said set along a longitudinal central portion thereof;

after said printing cycle and during another printing cycle, using said digital printing machine to print onto said one side of said continuous web additional first lateral rows of images;

during said another printing cycle, using said digital printing machine to print onto said opposite side of said continuous web additional second lateral rows of images;

cutting said continuous web longitudinally with respect to each portion thereof that is to define a two-page spread of another newspaper, and laterally with respect to each of said additional first and second lateral rows of images, so as to provide additional cut portions that define a two-page spread of the another newspaper;

in correspondence with said another printing cycle, combining said additional cut portions into an additional set; and folding said additional set along a longitudinal central portion thereof.

2. The method according to claim 1, wherein using said digital printing machine to print onto said one side of said continuous web additional first lateral rows of images comprises using said digital printing machine to sequentially print onto said one side said additional first lateral rows of images, and using said digital printing machine to print onto said opposite side of said continuous web additional second lateral rows of images comprises using said digital printing machine to sequentially print onto said opposite side said additional second lateral rows of images.

3. The method according to claim 2, wherein using said digital printing machine to sequentially print onto said one side of said continuous web said additional first lateral rows of images comprises using said digital printing machine to sequentially print onto said one side additional first lateral rows having contents that differ from row to row, and using said digital printing machine to sequentially print onto said opposite side of said continuous web said additional second lateral rows of images comprises using said digital printing machine to sequentially print onto said opposite side additional second lateral rows having contents that differ from row to row.

4. The method according to claim 3, wherein using said digital printing machine to sequentially print onto said one side of said continuous web said additional first lateral rows of images results in each of said additional first lateral rows defining at least two printed segments in a width direction of said continuous web, and using said digital printed machine to sequentially print onto said opposite side of said continuous web said additional second lateral rows of images results in each of said additional second lateral rows defining at least two printed segments in a width direction of said continuous web.

5. The method according to claim 4, wherein using said digital printing machine to sequentially print onto said one side of said continuous web said additional first lateral rows of images and to sequentially print onto said opposite side of said continuous web said additional second lateral rows of images results in said additional first lateral rows corresponding to said additional second lateral rows, respectively.

6. The method according to claim 5, wherein folding said additional set along a longitudinal central portion thereof comprises folding said additional set at said folding station, and further comprising:

in correspondence with said another printing cycle, delivering said additional set towards said folding station.

7. The method according to claim 6, wherein using said digital printing machine to sequentially print onto said one side of said continuous web said first lateral rows of images comprises using said digital printing machine to sequentially print said first lateral rows of images onto a portion of said one side that is moving in a vertical direction, using said digital printing machine to sequentially print onto said opposite side of said continuous web said second lateral rows of images comprises using said digital printing machine to sequentially print said second lateral rows of images onto a portion of said opposite side that is moving in a vertical direction, using said digital printing machine to sequentially print onto said one side of said continuous web said additional first lateral rows of images comprises using said digital printing machine to sequentially print said additional first lateral rows of images onto a portion of said one side that is moving in a vertical direction, and using said digital printing machine to sequentially print onto said opposite side of said continuous web said additional second lateral rows of images comprises using said digital printing machine to sequentially print said additional second lateral rows of images onto a portion of said opposite side that is moving in a vertical direction.

8. The method according to claim 7, wherein said digital printing machine includes first and second printing heads that are opposed to one another and arranged at the same level, using said digital printing machine to sequentially print said first lateral rows of images onto a portion of said one side that is moving in a vertical direction comprises using said first printing head to sequentially print said first lateral rows of images, using said digital printing machine to sequentially print said second lateral rows of images onto a portion of said opposite side that is moving in a vertical direction comprises using said second printing head to sequentially print said second lateral rows of images, using said digital printing machine to sequentially print said additional first lateral rows of images onto a portion of said one side that is moving in a vertical direction comprises using said first printing head to sequentially print said additional first lateral rows of images, and using said digital printing machine to sequentially print said additional second lateral rows of images onto a portion of said opposite side that is moving in a vertical direction comprises using said second printing head to sequentially print said additional second lateral rows of images.

9. The method according to claim 7, wherein said digital printing machine includes first and second printing heads that face in opposite directions and are arranged at different levels, using said digital printing machine to sequentially print said first lateral rows of images onto a portion of said one side that is moving in a vertical direction comprises using said first printing head to sequentially print said first lateral rows of images, using said digital printing machine to sequentially print said second lateral rows of images onto a portion of said opposite side that is moving in a vertical direction comprises using said second printing head to sequentially print said second lateral rows of images, using said digital printing machine to sequentially print said additional first lateral rows of images onto a portion of said one side that is moving in a vertical direction comprises using said first printing head to sequentially print said additional first lateral rows of images, and using said digital printing machine to sequentially print said additional second lateral rows of images onto a portion of said opposite side that is moving in a vertical direction comprises using said second printing head to sequentially print said additional second lateral rows of images.

* * * * *